US005647410A

United States Patent [19]

Nakagawa et al.

[11] Patent Number: 5,647,410

[45] Date of Patent: Jul. 15, 1997

[54] POWDER MOLDING MACHINE AND METHOD FOR FILLING MOLDING MATERIALS INTO A DIE CAVITY THEREOF

[75] Inventors: Takeo Nakagawa, Kawasaki; Hideaki Tsuru, Ichikawa; Yoshiharu Inaba, Kawasaki; Takayuki Taira, Hachioji; Masaki Muranaka, Tokyo, all of Japan

[73] Assignee: Fanuc, Ltd., Yamanashi, Japan

[21] Appl. No.: 211,001

[22] PCT Filed: Jul. 16, 1993

[86] PCT No.: PCT/JP93/00994

§ 371 Date: Mar. 14, 1994

§ 102(e) Date: Mar. 14, 1994

[87] PCT Pub. No.: WO94/02307

PCT Pub. Date: Feb. 3, 1994

[30] Foreign Application Priority Data

Jul. 17, 1992 [JP] Japan ..... 4-212267

[51] Int. Cl.[6] ..... B65B 1/04

[52] U.S. Cl. ..... 141/67; 141/250; 141/279

[58] Field of Search ..... 141/1, 67, 98, 141/284, 250, 279, 280; 264/238; 425/110, 317, 447

[56] References Cited

U.S. PATENT DOCUMENTS

| | | | |
|---|---|---|---|
| 3,107,702 | 10/1963 | Gex et al. | 141/280 X |
| 3,605,825 | 9/1971 | Hermes | 141/280 X |
| 3,877,862 | 4/1975 | Murray | 141/284 |
| 4,865,092 | 9/1989 | Reichelt | 141/280 |
| 5,000,661 | 3/1991 | Block et al. | 141/1 |
| 5,320,146 | 6/1994 | Stevie | 141/1 |

FOREIGN PATENT DOCUMENTS

| | | |
|---|---|---|
| 0 399381 | 11/1990 | European Pat. Off. . |
| 527766 | 6/1931 | Germany . |
| 50-24457 | 8/1975 | Japan . |
| 63-144898 | 6/1988 | Japan . |
| 2-160198 | 6/1990 | Japan . |

*Primary Examiner*—Henry J. Recla
*Assistant Examiner*—Steven O. Douglas
*Attorney, Agent, or Firm*—Staas & Halsey

[57] ABSTRACT

A powder molding machine capable of providing a uniform density of molding powders filled in a molding cavity of a die for improving the strength of molded products includes a die, upper and lower punches and a feeder, and is further provided with a feeder driving unit, which reciprocates a feed shoe between an advanced position at which molding powder is supplied to the die and a retracted position at which no interference occurs during a pressing operation by the punches. The feed driving unit includes a mechanism for enabling the feeder shoe to pass over the die and also to be swung in left and right directions while retracting and while still over the die.

7 Claims, 5 Drawing Sheets

POWDER MOLDING MACHINE AND METHOD FOR FILLING MOLDING MATERIALS INTO A DIE CAVITY THEREOF

TECHNICAL FIELD

The present invention relates to the improvement of a feeder and the improvement of a method for filling molding materials into a cavity in a powder molding machine designed to press molding powder supplied into a molding space (cavity) in a die by a punch to produce molded products.

BACKGROUND ART

A powder molding machine, as shown in FIG. 5, forcibly presses molding powder filled into a molding space (cavity) 3 of a die 2 by a punch (only a lower punch 14 is shown in FIG. 5), thus producing molded products. A feed shoe 1 is used for filling the molding powder into the aforesaid molding space 3.

The die 2 is usually mounted on a plate 27 having a flat surface so that the top surface of the die becomes flush with that of the plate. The feed shoe 1 is linearly reciprocated in the front and rear direction while sliding on the aforesaid plate 27. As seen from the cross-sectional view shown in FIG. 5, the feed shoe 1, having a shape just like that of an upside-down bowl, stores molding powder in its interior, and drops the molding powder stored in the interior into the molding space 3 of the die 2 as the feed shoe advances. The molding powder is always supplied from a hopper (not shown) located above the feed shoe 1 through a flexible hose 36.

After the feed shoe 1 is advanced to supply the molding powder S into the molding space 3 of the die, and is then retreated from the molding space 3, the surface of molding powders filled in the molding space 3 of the die becomes undulate. This is because portions having high density and low density appear almost like waves in the filled powder S. This is caused by the following reason: when the feed shoe 1 is retreated, a plurality of swirls, which rotate in a specific direction such as the moving direction of the feed shoe 1, are made in the powder filled in the interior of the feed shoe 1, as shown in FIG. 5, and these swirls disturb the uniformity of density of the molding powder filled in the molding hollow space 3 of the die 2. In particular, in the case where the depth of molding space 3 is shallow, the powder uniformly filled is easy to be disturbed when the feed shoe is retreated. For this reason, the density of the front-side portion of the powder S filled in the molding space 3 becomes low; on the other hand, the density of the rear-side portion of the powder S becomes high.

As described above, if the powder filled in a state in which the density is not uniform is pressed by means of a punch, the density of molded products thus obtained has a non-uniform density, and its strength lowers.

SUMMARY OF THE INVENTION

An object of the present invention is to provide a powder molding machine and a method for filling molding materials into a die cavity, which is capable of making the density of molding powder filled in a molding space (cavity) of a uniform, and improving the strength of the molded products.

To achieve the above object, the present invention provides a powder molding machine, wherein a plate and a die whose top surface is flush with the top surface of the plate are mounted to a frame, and a feed shoe is slidable on the plate to pass over a molding space defined in the die, thereby causing the molding materials stored in said feed shoe to be dropped into the molding space, including:

linear driving means for moving the aforesaid feed shoe in both the advancing and retreating or retracting directions with respect to the aforesaid molding space defined in the die from its retreat position;

swing driving means for swinging the said feed shoe in a direction generally traverse to the advancing and retreating directions; and a mechanism for giving the feed shoe a motion in a direction brought about by the combination of the aforesaid linear driving means and swing driving means when both means are driven.

Preferably, said swing driving means is fixed to a frame of the powder molding machine to rotate a casing supporting the feed shoe at a predetermined angle with respect to the frame, and the linear driving means is fixed to the casing to enable the feed shoe to project or retract from the casing.

More preferably, the powder molding machine further includes one or two or more position detecting means for detecting an arbitrary position between the retreat or retracted position and the most advanced position of the feed shoe, and transmission means for transmitting an output detected by the position detecting means to both or any one of said linear driving means and swing driving means.

In addition, the present invention provides a method for filling molding materials in a die cavity of a powder molding machine, comprising the steps of:

dropping molding materials stored in a feed shoe into a die cavity by moving the feed shoe over the die cavity from a retreat position; and swinging said feed shoe, when said feed shoe is retreating from the position of said die cavity to its retreat position, in transverse directions with respect to its retreating direction as long as at least a part of said feed shoe overlaps said cavity.

As described above, according to the present invention, the feed shoe passes over the cavity, during which powder is in the cavity, while being swung in the left and right directions when retreating, so that the uniformity of density of molding powders filled in the cavity will not be adversely affected by retreating motion of the feed shoe.

BEST MODE FOR CARRYING OUT THE INVENTION

Figure 3:
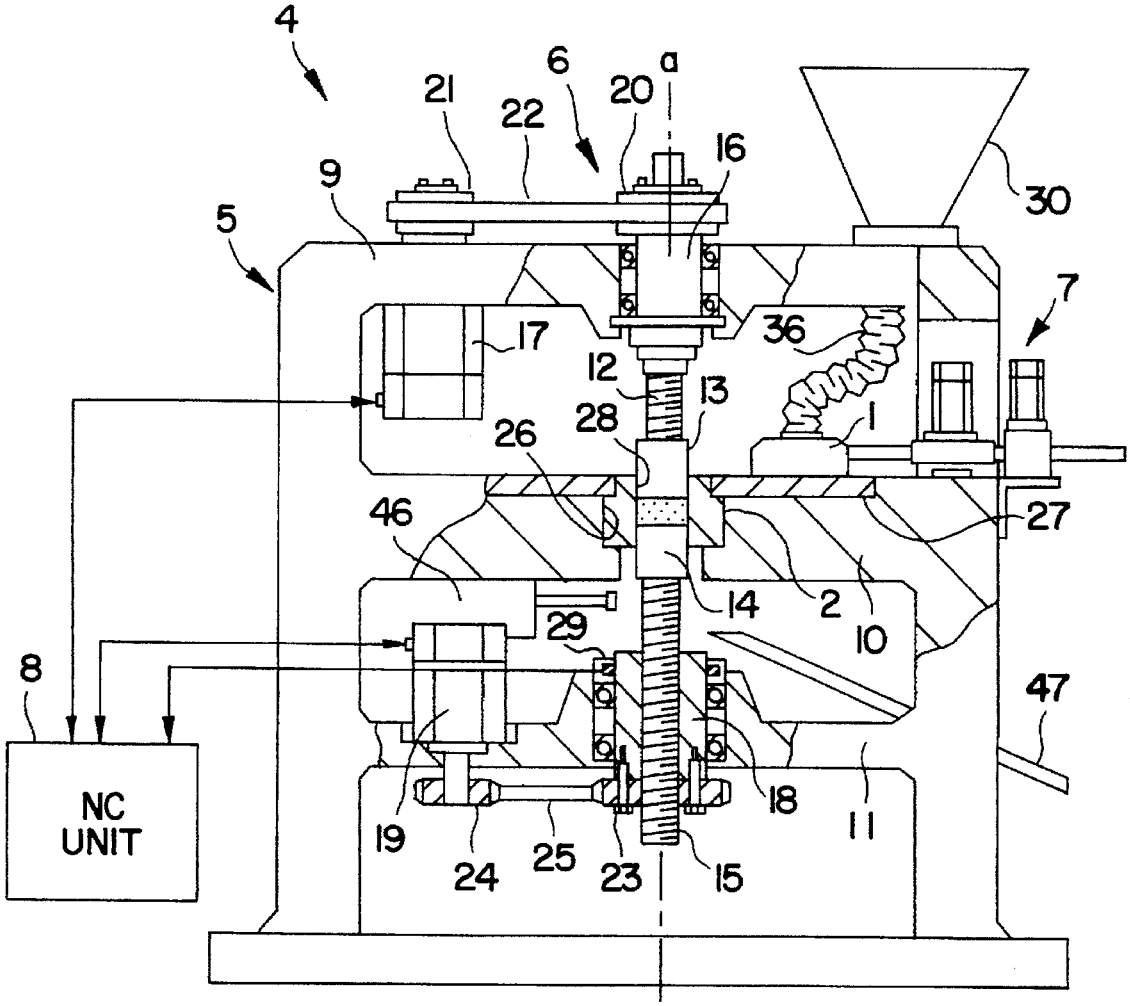
FIG. 3 is a partial sectional front view of the entirety of the powder molding machine.

A powder molding machine 4 has the configuration in which a molding device 6 and a feeder 7 are mounted on a frame 5 having an upper wall 9, an intermediate wall 10 and a lower wall 11, as shown in FIG. 3, and a drive of the machine is controlled by means of a NC unit 8.

A ball-bearing nut 16 is rotatably installed in the upper wall 9 of the frame 5, and engages with a ball-bearing screw 12 for driving an upper punch 13. A ball-bearing nut 18 is rotatably installed in the upper wall 9 of the frame 5, and engages with a ball-bearing screw 15 for driving a lower punch 14. In addition, the center of each of these ball-bearing screws 12 and 15 is aligned with an axis a extending in the up-and-down direction shown in FIG. 3.

A die mounting portion 26 with step, which has an opening penetrating in the up-and-down direction, and is coaxial with the aforesaid axis a, is formed in the intermediate wall 10 of the frame 5. The die 2 is mounted on the die mounting portion 26, and is fixed on the intermediate wall 10 by means of the plate 27. The top surface of the die 2 thus mounted is aligned with the top surface of the plate 27. The open space penetrating in the up-and-down direction is constituted so that the upper punch 13 attached to the distal end of the ball-bearing screw for driving the upper punch, and the lower punch 14 attached to the distal end of the ball-bearing screw 15 for driving the lower punch, are inserted into the space from above and below, respectively.

The ball-bearing nut 16 mounted on the upper wall 9 of the frame 5 is rotated by means of a drive of a servo motor 17 mounted on the upper wall 9 through a driving pulley 21 fixed on an output shaft of the servo motor 17, and a timing belt 22 wound around a driven pulley 20 fixed on the ball-bearing nut 16 and the aforesaid driving pulley 21. The ball-bearing nut 18 mounted on the lower wall 11 of the frame 5 is rotated by means of a drive of a servo motor 19 mounted on the lower wall 11 through a driving pulley 24 fixed on an output shaft of the servo motor 19, and a timing belt 25 wound around a driven pulley 23 fixed on the ball-bearing nut 18 and the aforesaid driving pulley 24.

When the upper and lower ball-bearing nuts 16 and 18 are rotated by means of the drive Of servo motors 17 and 19, respectively, the ball-bearing screws 12 and 15 for driving the upper and lower punches are moved up and down along the aforesaid axis a, thereby the upper and lower punches 13 and 14 being moved in a space of the die 2.

The molding device 6 comprises the upper and lower ball-bearing nuts 16 and 18, ball-bearing screws 12 and 15 for driving the upper and lower punches, upper and lower punches 13 and 14, and servo motors 17 and 19 for driving these ball-bearing nuts.

The NC unit 8 executes general operational sequence control of the molding powder machine, and molding program control according to inputted programs and data. A load cell 29 is installed in the lower ball-bearing nut 18 to detect the actual pressing force of upper the and lower punches which is applied to the molding powder supplied into the space of the die. The detected output data is fed back to the NC unit 8.

A hopper 30 for temporarily storing powdered molding materials is mounted on the upper wall 9 of the frame 5. A feeder 7 for filling the molding materials into the die cavity is installed in the intermediate wall 10. The details of the feeder 7 will be explained later.

In FIG. 3, the reference numeral 46 denotes an ejecting unit for ejecting molded products by an action of a solenoid, and the reference numeral 47 denotes a chute for receiving the molded products ejected by the aforesaid ejecting unit 46 from the lower punch 14.

The powder molding machine 4 described above with reference to FIG. 3 has a construction similar to that disclosed in Japanese Patent Laid-open Publication No. Hei 1-181997, for example.

Figure 1:
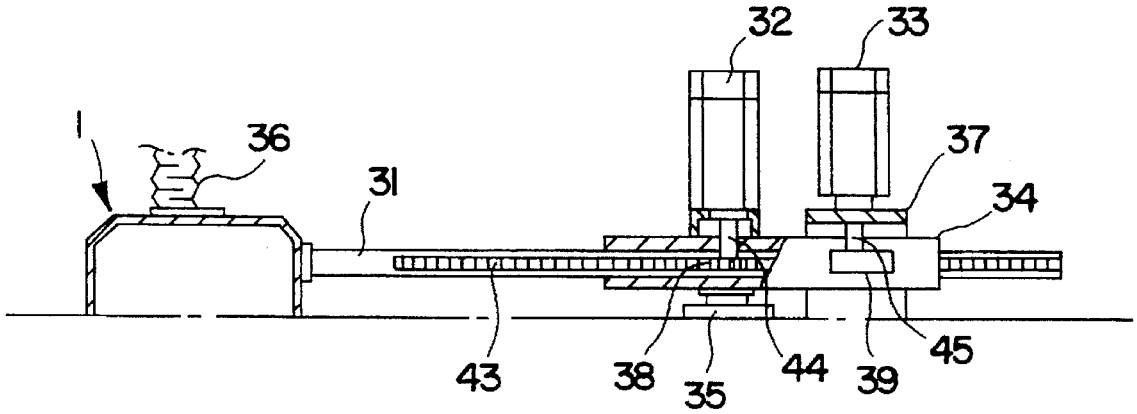
FIG. 1 is a partial sectional front view of a mechanism of a feed shoe according to the present invention.
Figure 2:
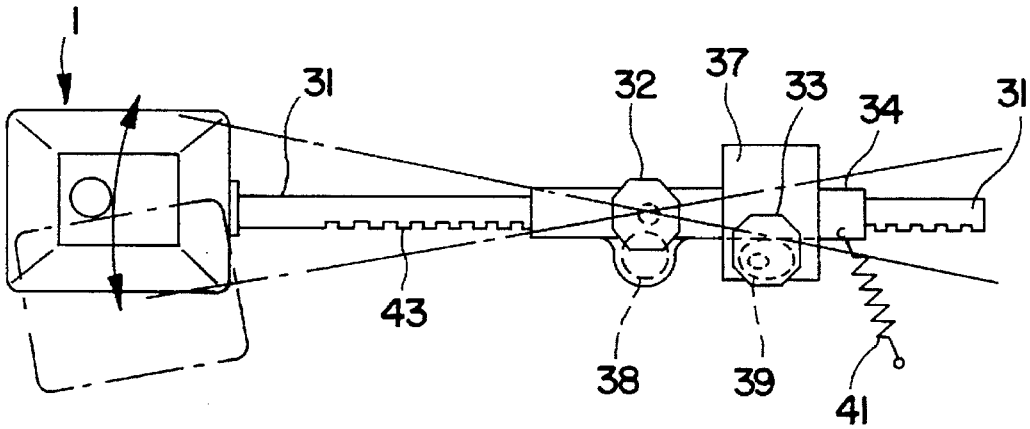
FIG. 2 is a top plan view of the associated mechanism of the feed shoe shown in FIG. 1.

In an embodiment according to the present invention, the aforesaid feeder 7 is characterized by including a feed shoe 1, which is mounted on the distal end of an arm 31, a motor 32 for linear motion, which gives advance/retreat motion to the aforesaid feed shoe 1, and a motor 33 for swinging motion, which gives left and right swinging motion to the aforesaid feed shoe 1, as shown in FIGS. 1 and 2. The details of the configuration will be described below.

A pivot 35 stands erect at the top surface of intermediate wall 10 of the frame 5, and a casing 34 is rotatably supported by means of the pivot 35, as shown in FIGS. 1 and 2.

The feed shoe 1 has a shape like an upside-down bowl similar to a conventional feed shoe, and its interior is defined so that molding powder can be stored therein. The molding powder is supplied to the interior of the feed shoe 1 through a flexible hose 36 connecting the feed shoe 1 with a hopper 30. A base end of the arm 31 is fixed to one side of the feed shoe 1.

The arm 31, which has a rack gear 43 formed on one side of the arm 31 over almost the entire length thereof, is inserted into the aforesaid casing 34. A notch is formed at one place on the side of the casing 34 so that the rack gear 43 of the arm 31 inserted in the casing 34 is exposed. The motor 32 for linear motion is installed on the top surface of the casing 34 in the vicinity of the portion where the aforesaid notch is formed so that an output shaft 44 of the motor is directed downward. A pinion gear 38, which is fixed to the distal end of the output shaft 44, engages with the rack gear 43 of the arm 31 inserted in the casing 34 through the aforesaid notch. Therefore, when the motor for linear motion is rotated in the normal or reverse direction, the arm 31 is projected or retracted from the casing 34.

A gate-shaped mounting base 37 for installing the motor 33 for swinging motion is mounted on the top surface of the intermediate wall 10 of the frame 5 so that it extends over the rear portion of the casing. The motor 33 for swinging motion is installed on the aforesaid mounting base 37 so that an output shaft 45 of the motor is directed downward. An eccentric cam 39 fixed to the distal end of the output shaft 45 is arranged so as to abut on a side face of the casing 34. The position at which the casing 34 abuts on the eccentric cam 39 is a short distance away from the pivot 35 rotatably supporting the casing 34 towards the reverse side of the feed-shoe side. Therefore, when the motor 33 for swinging motion is driven with respect to the casing 34 supported by the pivot 35, the casing 34 is pressed by rotation of the eccentric cam 39, and is swung at a predetermined angle with the pivot 35 being the central axis. An attracting spring 41, whose respective ends are fixed to the casing 34 and the intermediate wall 10, respectively, is used for always keeping the side face of the casing 34 in contact with the eccentric cam 39.

A molding operation of a powder molding machine according to an embodiment of the present invention will be described below.

Upper and lower punches 13 and 14, which are selected in accordance with a desired molded product, are respectively attached to the distal end of the ball-bearing screw 12 (for driving the upper punch) and to that of the ball-bearing screw 15 (for driving the lower punch). The die 2 corresponding to these upper and lower punches 13 and 14 is fitted into the die mounting portion 26 of the intermediate wall 10 of the frame 5, and is fixed so that the top surface of the die is flush with the top surface of the plate 27.

Also, the upper punch 13 is situated at the retreat position above and away from the die 2 before the powder molding machine is operated. On the other hand, the lower punch 14 is situated in a predetermined position located in the die space 28 penetrating through the center of the die 2, from below, thus defining the molding space 3 (cavity) by the die 2 and the lower punch 14. The feed shoe 1 of the feeder 7 is situated at the retreat position (shown by the broken line in FIG. 4) away from the die 2, and molding powder is supplied to the interior of the feed shoe from the hopper 30 through the flexible hose 36. The eccentric cam 39 is situated at the neutral position, that is, the arm 31 is in a state in which it is not inclined towards either left or right direction.

If an operation starting command is given to the NC unit 8 in the aforesaid state, the NC unit 8 controls the drive by each of servo motors 17 and 19 of the powder molding machine 4, the motor 32 for linear motion, and the motor 33 for swinging motion according to the specified machining programs and various data previously inputted.

When the operation starting command is given to the NC unit 8 in the state as described above, the motor 32 for linear motion is first driven in the normal direction. Then, the arm 31 fixing the feed shoe 1 is moved forward with respect to the casing 34 by engagement of the pinion gear 38 attached to the distal end of the output shaft 44 of the motor 32 for linear motion with the rack gear 43 formed in the arm 31. In other words, the feed shoe 1 is moved so that it advances toward the molding space 3 from the initial retreat or retracted position.

During advancing motion of the feed shoe 1, the motor 33 for swinging motion is not driven, so that the advancing motion of the feed shoe 1 becomes motion along a straight line. The casing 34 is kept in a state in which it is inclined to neither a left nor a right direction by the elastic force of the spring 41 and the contact with the eccentric cam 39.

Further, when the feed shoe 1 is moved on the plate 27 until reaching the overhead position of the molding space 3 defined by the die 2 and the lower punch 14, the molding powder stored in the interior of the feed shoe 1 is dropped into the molding space 3, thereby filling the molding space 3 with the molding powder.

Next, when the motor 32 for linear motion is driven in the reverse-rotational direction, the arm 31 is retreated or retracted. In other words, the feed shoe 1 is moved to the initial retreat position from the overhead position of the molding space 3. During retreating motion of the feed shoe 1, the motor 33 for swinging motion is driven. Therefore, when the eccentric cam 39 attached to the distal end of the output shaft 45 of the motor 33 for swinging motion is rotated, the casing 34 with the retreating arm 31 retracted thereinto is swung in left and right directions at a predetermined angle against elastic force of the spring 41.

Figure 4:
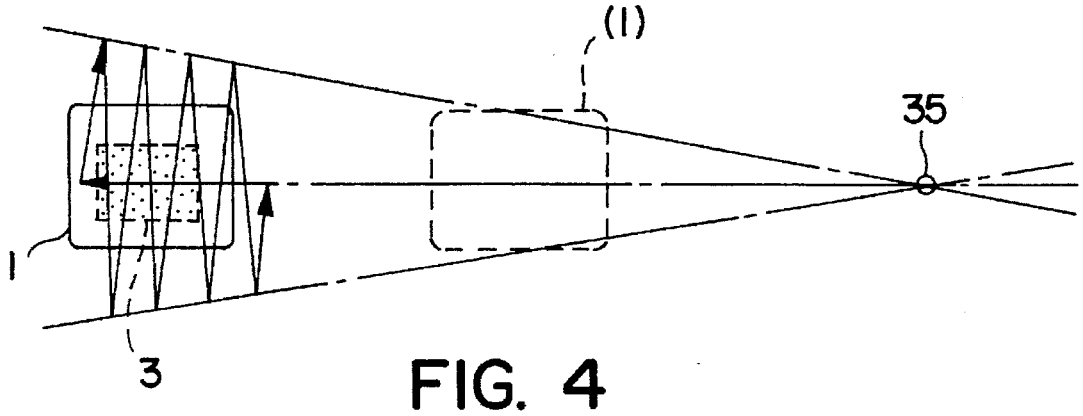
FIG. 4 is a view illustrating a retreating operation of the feed shoe according to the present invention.
Figure 5:
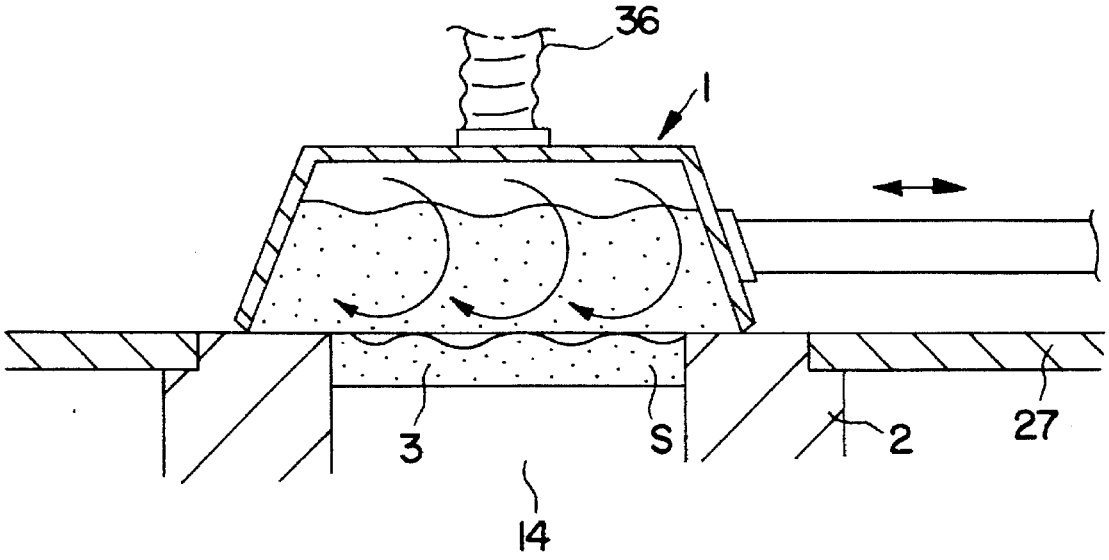
FIG. 5 is a cross-sectional view showing a state in which molding powders are supplied to the feed shoe by a conventional method.

When the feed shoe 1 passes through the overhead position of the molding space 3 filled with the molding powder while retreating, the feed shoe 1 is moved while swinging in the left and right direction, as indicated by a moving locus of an arbitrary point in the feed shoe 1 shown in a top plan view of FIG. 4. Thus, the density of the molding powder in the space 3 of the die is prevented from being uneven.

The motor 33 for swinging motion is driven as long as the retreating feed shoe 1 overlaps even partially with the molding space 3. The position where the drive of the motor 33 for swinging motion is stopped may be set by locating a limit switch (not shown) in a predetermined position, or may be the same as the position where the motor 33 for linear motion is stopped. It is necessary, however, for the motor 33 for swinging motion to be set to stop at the point at which the eccentric cam 39 comes to rest at its neutral position.

When the feed shoe 1 reaches the initial retreat position, the motor 32 for linear motion is stopped. The position where the feed shoe 1 is stopped is set by locating a limit switch (not shown) at a predetermined position in the intermediate wall 10 of the frame 5. In this case, a position where the feed shoe 1 does not interfere with a subsequent punch pressing operation is selected as the aforesaid stop position of the feed shoe.

After that, the powder filled in the molding space undergoes a compression molding operation according to the ordinary method. More specifically, when the servo motor 17 for driving the upper punch is rotated in the normal direction, the upper ball-bearing nut 16 is rotated through the driving pulley 21, timing belt 22, and driven pulley 20. Then, the ball-bearing screw 12 for driving the upper punch is caused to come down by the rotation of the upper ball-bearing nut 16, by which the upper punch 13 attached to the distal end of the ball-bearing screw 12 is inserted into the molding space 3 to press the molding powder filled in the molding space 3. The servo motor 19 for driving the lower punch is simultaneously driven in the normal direction, by which the lower ball-bearing nut 18 is rotated through the driving pulley 24, timing belt 25, and driven pulley 23 to cause the ball-bearing screw 15 for driving the lower punch to be lifted.

In this manner, the molding powder filled in the molding space 3 is pressed from above and below by means of the upper and lower punches 13 and 14. Therefore, a large pressing force can be provided, and the portion where the density of the pressed powder is relatively low can be set to the middle portion in the up-and-down direction. However, in the case where there is no need of a large pressing force, such as when a molded product with a small thickness is required, or the like, the pressing operation described above may be carried out by only the descending linear motion of the ball-bearing screw 12 for driving the upper punch under the condition that the servo motor 19 for driving the lower punch is locked by means of a solenoid brake or the like.

A pressing force generated by descending linear motion of the ball-bearing screw 12 for driving the upper punch, or by the combination of descending linear motion of the ball-bearing screw 12 for driving the upper punch and ascending linear motion of the ball-bearing screw 15 for driving the lower punch, is detected by means of the load cell 29 mounted on the lower ball-bearing nut 18, and is inputted to the NC unit 8 as a feedback signal.

The NC unit 8 controls the command supplied to the servo motors 17 and 19 on the basis of the aforesaid feedback signal, and keeps the pressing force at a preset value. When a preset time has elapsed, the servo motors 17 and 19 for driving the upper and lower punches will be stopped, thereby releasing the molded product from the pressing force applied. Then, the servo motor 19 for driving the lower punch is driven in the reverse direction, while the servo motor 17 for driving the upper punch is driven in the normal direction. Descending motion of the ball-bearing screw 15 for driving the lower punch and that of the ball-bearing screw 12 for driving the upper punch take place at equal speeds. This will cause the upper and lower punches 13 and 14 to come down through the die space 28 in a state in which the interval between the both is kept constant, whereby the molded product is taken out of the die 2 in a state in which it is laid on the top surface of the lower punch 14.

When the molded product is taken out of the die 2, the servo motor 19 for driving the lower punch is stopped, while the servo motor 17 for driving the upper punch is driven in the reverse direction. Simultaneously, the molded product ejecting unit 46 is driven to eject the molded product laid on the lower punch 14 into the chute 42, thereby enabling the molded product to be taken out of the powder molding machine 4. Further, the servo motor 17 for driving the upper punch is driven in the reverse direction and a drive of the servo motor 19 for driving the lower punch is driven in the normal direction, whereby the upper and lower punches 13 and 14 are returned to the aforesaid initial position to complete one cycle of the molding operation.

As described above, in the present embodiment, to obtain the construction in which the feed shoe is moved to the overhead position of the die cavity from the retreat position, and the feed shoe is retreated toward the aforesaid retreat position while being swung in left and right directions as it is moved toward the aforesaid retreat position, two motors 32 and 33 are used as components for the above construction, which function as linear driving means and swing driving means, casing 34, eccentric cam 39, arm 31 with a rack, and the like. However, all of the operations of the feed shoe which take place on the plate 27 may be replaced by a robotic operation.

Concerning the filling of the specific molding material, explained in the following is an example of a comparative test in which the result of filling in the case (A) where the feed shoe is first advanced straight for filling and then retreated straight and the result of the filling in the case (B) where the feed shoe is advanced straight and retreated while being swung towards lift and right directions.

In this test, a water-atomized iron powder (apparent density of 2.93 $Mg.m^{-3}$) was mixed with lead stearate of 1% by weight as a lubricant by means of a rolling mill for half an hour to prepare a mixture (with apparent density of 3.24 $Mg.m^{-3}$ and particle size of 70 to 100 μm) for use in the test. A die cavity to be filled with the powder was of square shape with equal sides of 70 mm (with corner R of 5 mm) and depth of 1 mm. A linear speed in the directions of advancing and retreating of the feed shoe was set to 150 mm/sec. In addition, a swinging motion of the feed shoe for obtaining the result of filling in the case (B) was performed for every 5 mm of retreating motion, with 18 mm of amplitude of that swinging motion set.

Figure 6:
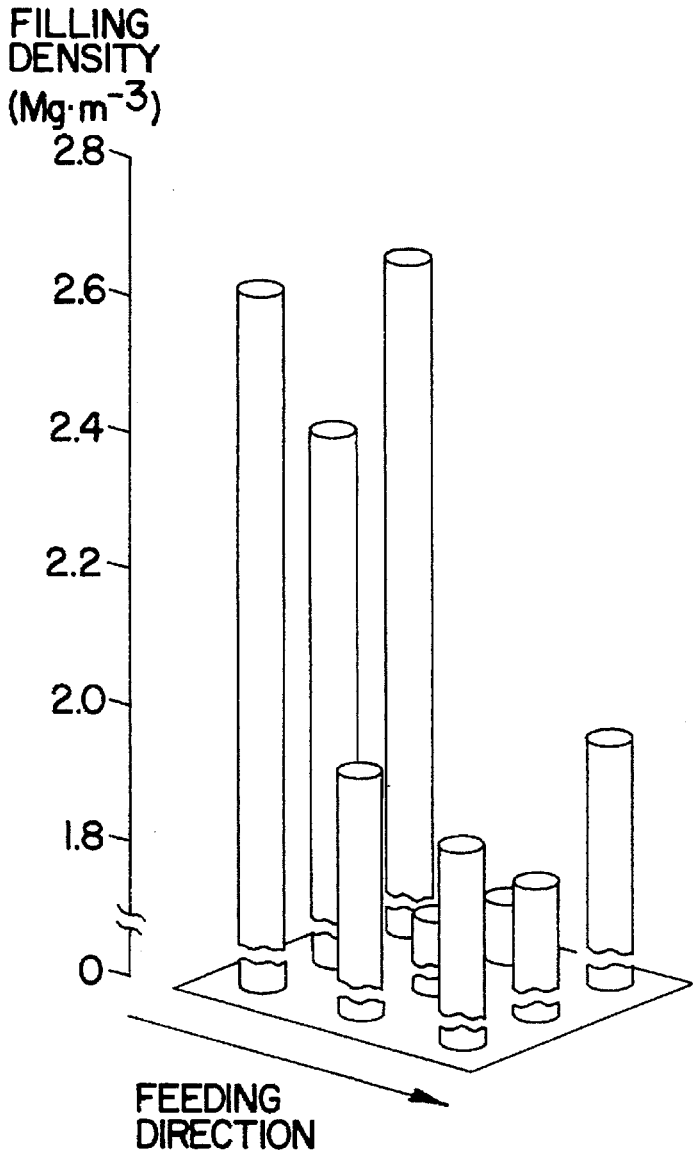
FIG. 6 is a graph illustrating density distribution when molding materials are filled in the cavity by the conventional method.
Figure 8:
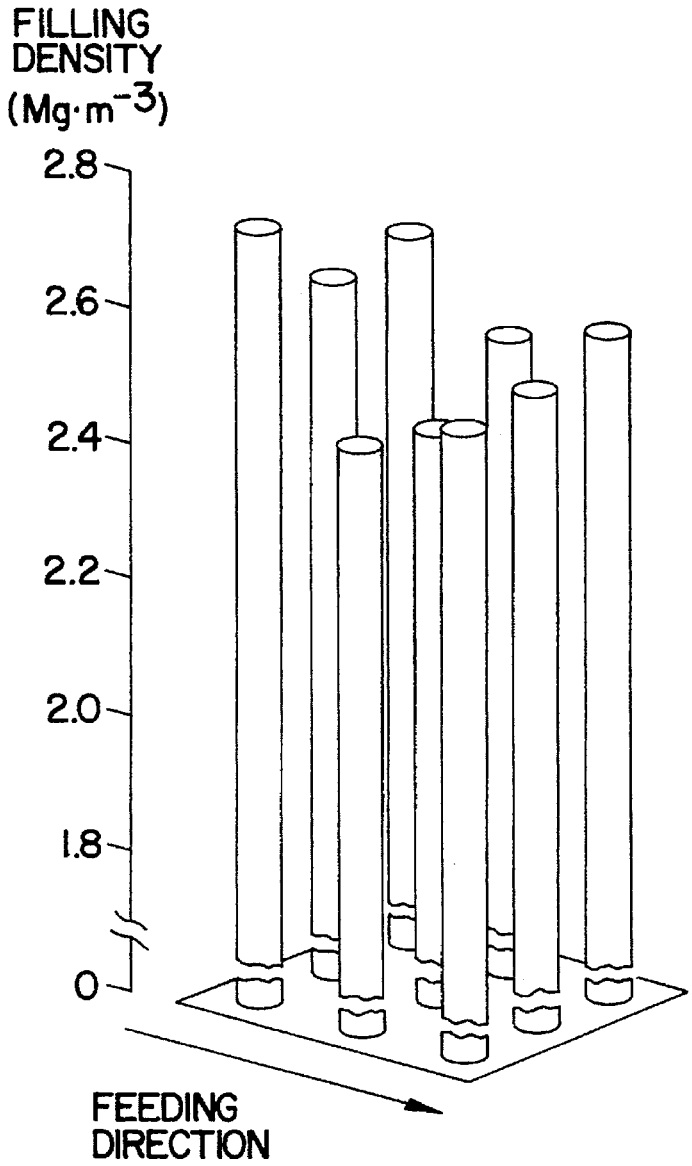
FIG. 8 is a graph illustrating density distribution when molding materials are filled in the cavity by the method according to the present invention.

FIGS. 6 and 8 are bar graphs showing average density at each of nine different portions (3 times 3 equals 9) in the powder filled into the cavity in the cases of (A) and (B). Comparing these bar graphs, it can be seen that dispersion of filling density in the cavity in the filling result of case (B) was less than that,of the filling result of case (A). In addition, the general average of the density of the filled powder in the case (B) was higher than that of the filled powder in the case (A).

Figure 7:
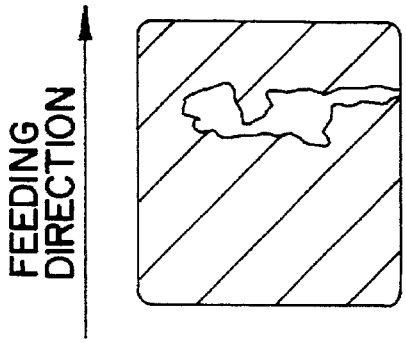
FIG. 7 is a schematic view showing an appearance of powder when molding materials are filled in the cavity by the conventional method.
Figure 9:
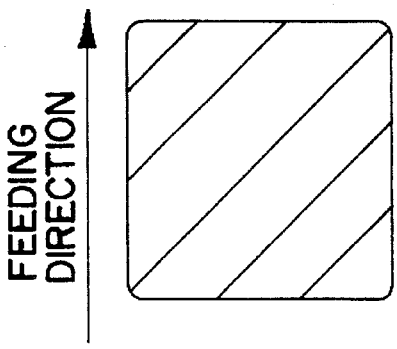
FIG. 9 is a schematic view showing an appearance of powder when molding materials are filled in the cavity by the method according to the present invention.

FIGS. 7 and 9 schematically show the appearance of each of pressed powders representing the filled results of case (A) and case (B). As seen from FIG. 7, the portion located at the level about ⅔ in the cavity viewed from the advancing direction of the feed shoe is blank, indicating that the blank portion is a poorly filled portion. On the other hand, in FIG. 9, when observed carefully, a striped pattern caused by the swinging operation of the feed shoe can be recognized, but the blank portion, as shown in FIG. 7 does not appear therein. This means that filling has been done evenly.

As is obvious from this test, a better filling result can be obtained in the case where the feed shoe is retreated while being swung after it is linearly advanced to fill the molding materials in the cavity than in the case where the feed shoe is linearly retreated after it is linearly advanced to fill the molding materials in the cavity.

What is claimed is:

1. A powder molding machine, comprising:

a frame;

a plate mounted on said frame and having a top surface;

a die having a top surface flush with the top surface of said plate, said die having a molding cavity defined therein;

a feed shoe slidable along the top surface of said plate and having a space therein for holding molding materials, said molding materials dropping into said molding cavity when said feed shoe passes over said molding cavity;

linear driving means for moving said feed shoe in a linear direction from a retracted position to a position over said molding cavity and for retracting said feed shoe back to said retracted position;

swing driving means for driving said feed shoe in a non-circular motion by swinging said feed shoe in directions traverse to said linear direction and cooperating with said linear driving means for swinging said feed shoe during retraction to said retracted position; and control means for causing simultaneous operation of said linear driving means and said swing driving means while said shoe overlaps any part of said molding cavity and is being retracted to said retracted position to create a combination of retracting said linear and swinging transverse motions of said shoe to uniformly distribute said molding materials throughout said molding space.

2. A powder molding machine according to claim 1, further comprising:

a casing rotatably attached to said frame, said shoe being operatively connected to an inner end of said casing; and wherein said linear driving means and said swing driving means are connected to said casing to cause said linear and swinging transverse motions of said shoe.

3. A powder molding machine according to claim 2, wherein said linear driving means includes a rack and pinion mechanism.

4. A powder molding machine according to claim 2, wherein said swing driving means includes cam means in contact with said casing to cause swinging movement of said shoe.

5. A powder molding machine according to claim 1, further comprising:

position detecting means for detecting a predetermined position between the most retracted position and the most advanced position of said feed shoe; and transmitting means for transmitting an output detected by said position detecting means to at least one of said linear driving means and said swing driving means.

6. A method for filing molding materials in a die cavity of a powder molding machine, comprising the steps of:

dropping molding materials stored in a feed shoe into a die cavity by advancing said feed shoe to a position over said die cavity from a retracted position; and driving said feed shoe in a non-circular motion, as said feed shoe is retracted from the position over said die cavity to its retracted position, in transverse directions to its retracting direction as long as at least a part of said feed shoe overlaps said cavity.

7. A powder molding machine, comprising:

a frame;

a plate mounted on said frame and having a top surface;

a die having a top surface flush with the top surface of said plate, said die having a molding cavity defined therein;

a feed shoe slidable along the top surface of said plate and defining a space to hold molding materials, said molding materials dropping into the molding cavity when said feed shoe passes over said molding cavity;

a motor to linearly move said feed shoe between a retracted position and a position over said molding cavity; and a rack and pinion mechanism to swing said feed shoe in a non-circular motion traverse to said linear movement during retraction of said feed shoe.

* * * * *